US005595081A

United States Patent [19]

Nuzzo et al.

[11] Patent Number: 5,595,081

[45] Date of Patent: Jan. 21, 1997

[54] LOCKABLE CONTAINER, SUCH AS TOY SAFE

[75] Inventors: Joseph V. Nuzzo, Willowbrook; John F. Miroballi, Schaumburg, both of Ill.

[73] Assignee: Penta Products, Inc., Villa Park, Ill.

[21] Appl. No.: 492,624

[22] Filed: Jun. 20, 1995

[51] Int. Cl.[6] ..... E05B 17/00

[52] U.S. Cl. ..... 70/446; 70/465; 109/1 V

[58] Field of Search ..... 109/1 R, 1 V, 109/24.1; 70/432, 441, 442, 446, 465

[56] References Cited

U.S. PATENT DOCUMENTS

| | | | |
|---|---|---|---|
| 550,717 | 12/1895 | Hallenbeck | 109/1 V |
| 1,410,027 | 3/1922 | Nanni | 109/1 V |
| 1,516,531 | 11/1924 | Halteman et al. | 109/1 V |
| 3,536,017 | 10/1970 | Lucas | 70/446 X |
| 4,389,194 | 6/1983 | Toll et al. | 109/1 R X |
| 5,157,950 | 10/1992 | Demarest, Jr. | 70/446 X |
| 5,350,338 | 9/1994 | Hellman, Jr. | 109/1 V X |
| 5,359,867 | 11/1994 | Ling et al. | 70/446 X |
| 5,465,090 | 11/1995 | Deignan | 109/24.1 X |

*Primary Examiner*—Suzanne L. Dino

*Attorney, Agent, or Firm*—Dressler, Goldsmith, Milnamow & Katz, Ltd.

[57] ABSTRACT

A lockable container, such as a toy safe, comprises a box having an upper wall, a lower wall, a back wall, and two side walls and having a front opening. A front door hinged to the box is movable between a closing position, in which the front door closes the front opening, and other positions, in which the front door does not close the front opening. A shelf disposed within the box extends from the back wall, between the side walls. A combination lock is mounted on the front door for locking the front door in the closing position and for unlocking the front door upon manipulation of the combination lock in accordance with a combination of alphanumeric characters. The front door has an inner surface, on which the combination is displayed below the shelf. The displayed combination is visible, when the front opening is closed by the front door, through one of a series of open vents provided in the back wall, below the shelf, at least if and when the combination is illuminated through another of the series of open vents.

7 Claims, 1 Drawing Sheet

LOCKABLE CONTAINER, SUCH AS TOY SAFE

TECHNICAL FIELD OF THE INVENTION

This invention pertains to a lockable container, such as a toy safe, which employs a combination lock. As needed to unlock the combination lock, a combination of numbers or letters is displayed on an inner surface of a front door of the container, or on an inner surface of a wall, preferably on the inner surface of the front door. At least if and when illuminated and if not obscured by contents, the displayed combination is visible, when the front opening is closed by the front door, through a vent provided in a wall, preferably in a back wall, or in the front door.

BACKGROUND OF THE INVENTION

Commonly, toy safes employ combination locks, which are unlocked by manipulation in accordance with combinations of two, three, or more alphanumeric characters, usually two or three numbers or two or three letters. Lockable containers of other types, such as liquor cabinets, may employ such locks.

Problems can arise with a lockable container employing a combination lock, particularly with a toy safe employing such a lock, if the combination of alphanumeric characters needed for unlocking the lock is lost, misplaced, or forgotten. It would cause such a lock to be largely useless if the needed combination were displayed where such combination could be easily viewed by a casual observer.

However, it would be very useful if the needed combination could be displayed where it could be viewed by an informed observer, but not by an uninformed observer. If the lockable container would be a toy safe used by a young child, the informed observer could be a parent, a babysitter, or an older sibling.

SUMMARY OF THE INVENTION

This invention provides a lockable container, such as a toy safe, which may have an upper wall, a lower wall, a back wall, and two side walls. The lockable container has a front opening and a front door hinged to the container so as to be movable between a closing position, in which the front door closes the front opening, and other positions, in which the front door does not close the front opening. The lockable container has means including a combination lock mounted on the front door for locking the front door in the closing position and for unlocking the front door upon manipulation of the lock in accordance with a combination of alphanumeric characters.

In accordance with this invention, the combination is displayed on an inner surface of one of the upper, lower, back, and side walls or of the front door, preferably on the inner surface of the front door. Moreover, when the front opening is closed by the front door, the displayed combination is visible through a vent provided in another of the upper, lower, back, and side walls or in the front door, preferably in the back wall, at least if and when the displayed combination is illuminated.

The vent may be one of a series of vents provided therein, whereby the displayed combination is visible through one of the series of vents, at least if and when the displayed combination is illuminated through another of the series of vents. Preferably, if the lockable container has a shelf, the combination is displayed below the shelf. Preferably, moreover, the displayed combination is visible through one of the series of vents, below the shelf.

Although open vents are preferred, screened windows or windows having transparent panes may be alternatively provided for observing and illuminating the displayed combination.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
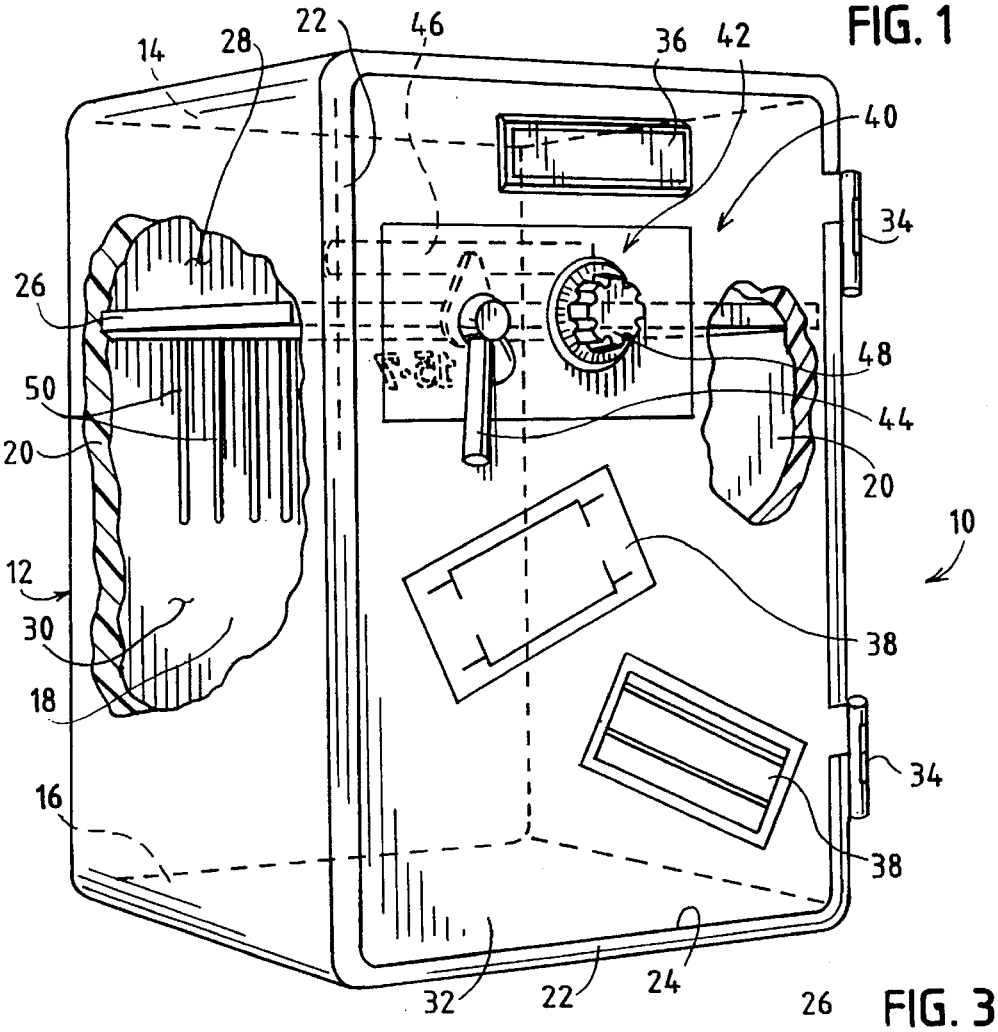
FIG. 1 is a partly fragmentary, perspective view of a toy safe, which constitutes a preferred embodiment of this invention.

As shown in FIG. 1, a toy safe 10 constitutes a preferred embodiment of this invention. Although the preferred embodiment is a toy safe, this invention may be also embodied as a lockable container of another type, such as a liquor cabinet or a storage cabinet for compact disks or computer disks.

The toy safe comprises a generally rigid box 12 molded in one piece so as to have an upper wall 14, a lower wall 16, a back wall 18, and two side walls 20, so as to have a front lip 22 defining a front opening 24. A shelf 26 disposed within the box 12 is mounted therewithin so as to extend from the back wall 18, between the side walls 20, and so as to divide the box 12 into an upper chamber 28 comprised of about one third of the box volume and a lower chamber 30 comprised of about two thirds of the box volume.

The toy safe 10 also comprises a front door 32, which is hinged to the box 12 via two hinges 34 mounted operatively to the front door 32 and to the front lip 22, along one of the side walls 20, so as to be movable between a closing position, in which the front door 32 closes the front opening 24, and other positions, in which the front door 32 does not close the front opening 24. An adhesive sticker 36 bearing a child's name and adhesive stickers 38 bearing playful messages are applied to the front door 32.

The toy safe 10 is equipped with a locking mechanism 40 comprising a combination lock 42, which may be of a conventional type, and a locking lever 44, which also may be of a conventional type. The locking lever 44 is connected operatively to a locking link 46, which also may be of a conventional type. The locking link 46 coacts with the front lip 22, along the side wall 20 opposite to the side wall 20 where the front door 32 is hinged, for locking the front door 32 in the closing position when the locking lever 44 is disposed in a normal position, in which the locking lever 44 is shown and to which the locking lever 44 is biased, and for unlocking the front door 32 when pivoted from the normal position into a pivoted position, in a clockwise direction in FIG. 1.

The combination lock 42 is operable selectively and coactively with the locking lever 44 and with the locking link 46 for locking the front door 32 in the closing position, by locking the locking lever 44 in the normal position, and for unlocking the front door 32, by unlocking the locking lever 44 and permitting the locking lever 44 to be pivoted into the pivoted position, upon manipulation of a rotary dial 48 of the combination lock 42 in accordance with a combination of two, three, or more alphanumeric characters. A combination of two numbers is preferred for the toy safe 10, which is designed for a young child to use. As an example, a combination of "15" and "7" is shown. Rather than a combination of two, three, or more numbers, a combination of two, three, or more letters may be alternatively used. In the drawings, the locking mechanism 40 including the combination lock 42 with the rotary dial 48, the locking lever 44, and the locking link 46 is shown schematically, not realistically, as details of the locking mechanism 40 are outside the scope of this invention.

The back wall 18 is provided with a series of horizontally spaced, vertically elongated, open vents 50, which are designed to allow air to pass freely into and out from the lower chamber 30. The shelf 26 is dimensioned to leave a gap (not shown) between a front edge 52 of the shelf 26 and the front door 32 in the closing position. The gap therebetween is intended to allow air to pass freely between the upper chamber 28 and the lower chamber 30. Therefore, if a pet were locked in the toy safe 10 by an unthinking child, the pet could breathe through the vents 50. Moreover, a child using the toy safe 10 could slip money and other slim objects through the vents 50, into the lower chamber 30.

In accordance with the preferred embodiment of this invention, the combination of alphanumeric characters is displayed on an inner surface 60 of the front door 32, near but below the shelf 26. The combination of alphanumeric characters may be so displayed via a decal, label, or sticker 62 applied adhesively to the inner surface 60, as shown, or otherwise.

Figure 2:
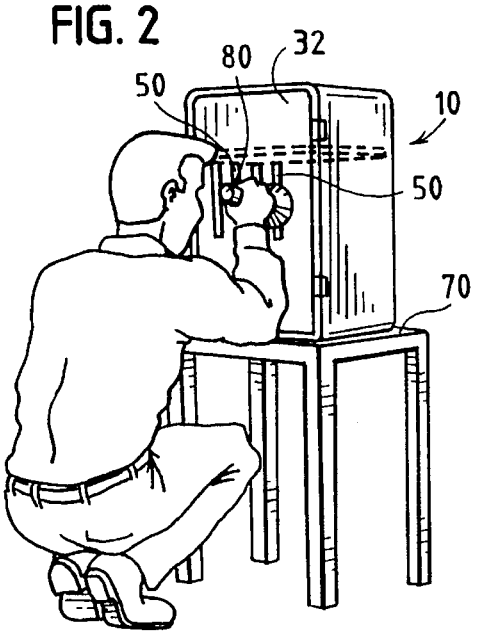
FIG. 2, on a smaller scale, is a pictorial view of a crouching person observing a lock combination through one of a series of vents in a back wall of the toy safe, on a table, while employing a flashlight to illuminate the lock combination through another of the series of vents.
Figure 3:
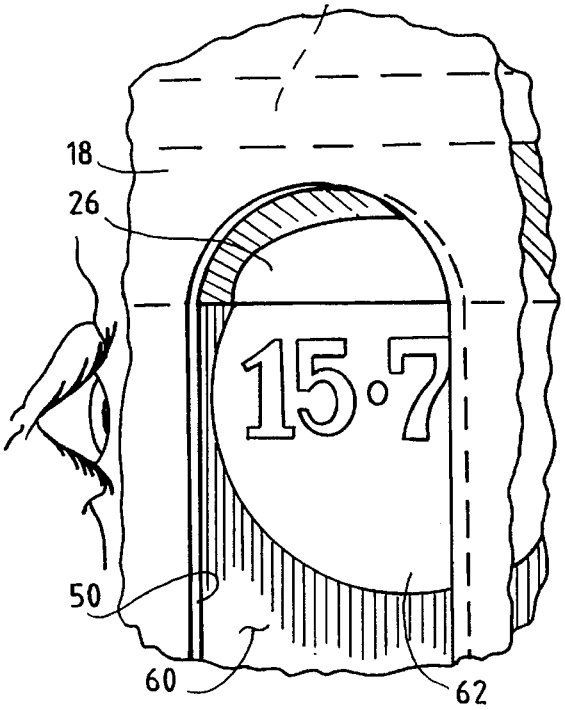
FIG. 3, on a larger scale, is a fragmentary detail showing the lock combination, as visible through one of the series of vents.

This invention contemplates that the displayed combination is visible, when the front opening 24 is closed by the front door 32, through one of the vents 50, at least if and when the combination is not obscured by contents of the lockable container and is illuminated. If ambient illumination is insufficient, the displayed combination may be artificially illuminated through another of the vents 50. In FIG. 2, in which the toy safe 10 is on a table 70, a crouching person is observing the displayed combination through one vent 50 while employing a flashlight 80 to illuminate the displayed combination through another vent 50.

It is preferable to display the combination of alphanumeric characters near but below the shelf 26, where the displayed combination is least likely to be obscured by toys or other contents of the lower chamber 30. In some instances, it may be necessary to shake the toy safe 10 so as to displace toys or other contents obscuring the displayed combination.

Alternatively but less desirably, the combination of alphanumeric characters may be similarly displayed on an inner surface of one of the box walls, so as to be similarly visible through such a vent in another of the box walls or in the front door 32, or on a lower surface of the shelf 26, so as to be similarly visible through one of the vents 50 in the back wall 18 or through such a vent in another of the box walls or in the front door. It would be possible but even less desirable to display the combination of alphanumeric characters on the lower surface of the upper wall 14 or on the upper surface of the lower wall 16.

The toy safe 10 may be predominantly made from an injection-molded engineering polymer, such as high-impact polystyrene. Even the locking mechanism 40 may be predominantly polymeric.

Rather than open vents 50, as shown, screened windows or windows covered by transparent panes may be alternatively provided for observing and illuminating the displayed combination. Although open vents 50, as shown, or screened windows would ventilate the toy safe 10, windows covered by transparent panes would not ventilate the toy safe 10.

Various other modifications may be made in the preferred embodiment described above without departing from the scope and spirit of this invention.

We claim:

1. A lockable container comprising a box having an upper wall, a lower wall, a back wall, and two side walls and having a front opening, a front door hinged to the box so as to be movable between a closing position, in which the front door closes the front opening, and other positions, in which the front door does not close the front opening, a shelf disposed within the box so as to extend from the back wall, between the side walls, and means including a combination lock mounted on the front door for locking the front door in the closing position and for unlocking the front door in accordance with a combination of alphanumeric characters, the front door having an inner surface, on which the combination is displayed below the shelf, the displayed combination being visible from outside the lockable container when the front opening is closed by the front door, through one of a series of open vents provided in one of the upper, lower, back, and side walls, at least if and when the displayed combination is not obscured by contents of the lockable container and is illuminated, as through another of the series of open vents.

2. A lockable container comprising a box having an upper wall, a lower wall, a back wall, and two side walls and having a front opening, a front door hinged to the box so as to be movable between a closing position, in which the front door closes the front opening, and other positions, in which the front door does not close the front opening, and means including a combination lock mounted on the front door for locking the front door in the closing position and for unlocking the front door in accordance with a combination of alphanumeric characters, each of the upper, lower, back, and side walls having an inner surface, the front door having an inner surface, the combination being displayed on the inner surface of one of the upper, lower, back, and side walls or of the front door, the displayed combination being visible from outside the lockable container when the front opening is closed by the front door, through a vent provided in another of the upper, lower, back, and side walls or, unless the combination is displayed on the inside surface of the front door, provided in the front door, at least if and when the displayed combination is not obscured by contents of the lockable container and is illuminated.

3. The lockable container of claim 2 wherein the combination of alphanumeric characters is displayed on the inner surface of the front door and wherein the vent is provided in one of the upper, lower, back, and side walls.

4. The lockable container of claim 3 wherein the vent is provided in the back wall.

5. The lockable container of claim 4 wherein the vent is one of a series of vents, the displayed combination being visible through a selected one of the series of vents.

6. The lockable container of claim 5 wherein the combination of alphanumeric characters is displayed on the inner surface of the front door and wherein the vents are provided in the back wall.

7. A lockable container comprising a box having a front opening, a front door hinged to the box so as to be movable between a closing position, in which the front door closes the front opening, and other positions, in which the front door does not close the front opening, and means including a combination lock mounted on the front door for locking the front door in the closing position and for unlocking the front door upon manipulation of the combination lock in accordance with a combination of alphanumeric characters, the combination being displayed on an inner surface of the lockable container and being visible from outside the lockable container when the front opening is closed by the front door, through a vent or window provided in the lockable container, at least if and when the displayed combination is not obscured by contents of the lockable container and is illuminated.

* * * * *